US005425322A

United States Patent [19]

Ziober

[11] Patent Number: 5,425,322

[45] Date of Patent: Jun. 20, 1995

[54] PORTABLE FOLDING PERSONAL WATER CRAFT MOORING STANDOFF APPARATUS

[76] Inventor: James R. Ziober, 6N006 Riverside Dr., St. Charles, Ill. 60174

[21] Appl. No.: 288,730

[22] Filed: Aug. 15, 1994

[51] Int. Cl.[6] ..... B63C 7/00

[52] U.S. Cl. ..... 114/44; 114/230; 405/1

[58] Field of Search ..... 114/44, 49, 50, 344; 405/1, 3, 7; 280/414.1

[56] References Cited

U.S. PATENT DOCUMENTS

| | | | |
|---|---|---|---|
| 2,754,017 | 7/1956 | Hart et al. | 405/1 |
| 3,227,292 | 1/1966 | Jacobs | 405/1 |
| 5,005,846 | 4/1991 | Taylor | 114/344 |
| 5,016,893 | 5/1991 | Hart, Jr. | 248/129 |
| 5,163,378 | 11/1992 | Raymond | 114/44 |
| 5,184,913 | 2/1993 | Meriwether | 405/3 |
| 5,249,545 | 10/1993 | Gettman | 114/259 |

*Primary Examiner*—Jesus D. Sotelo
*Attorney, Agent, or Firm*—Kajane McManus

[57] ABSTRACT

The portable folding personal water craft mooring standoff comprises an apparatus which will provide a platform upon which a personal water craft may be moored above a water line when it is not in use. The apparatus is comprised of two main components which are fully transportable for use in shallow water off the shore. The apparatus is transported to the water, assembled, and then a personal water craft can be propelled onto the stand for temporary above water mooring. Once the water craft is to be used again, a rider mounts the water craft and uses weight and momentum to release the craft from the mooring and back into the water.

6 Claims, 6 Drawing Sheets

PORTABLE FOLDING PERSONAL WATER CRAFT MOORING STANDOFF APPARATUS

BACKGROUND OF THE INVENTION

The present invention relates to a portable folding personal water craft mooring standoff apparatus for the temporary mooring of a personal water craft, in shallow water. More particularly, the apparatus comprises a two unit structure which allows a personal water craft to be secured in a fixed manner above the water's surface at a position adjacent a shoreline, to avoid contact between the shoreline and the craft. The apparatus uses the propulsion of the personal water craft to engage a mooring mechanism thereof.

THE PRIOR ART

Various forms of water craft mooring apparatus have been proposed.

For example, the Taylor U.S. Pat. No. 5,005,846 discloses a jet ski transporter carriage for use in loading and unloading of a jet ski onto and from a personal vehicle such as a pickup truck or trailer, and can be used to retrieve the jet ski at water's edge for transport. The carriage is a tubular steel framework shaped to compatibly receive the jet ski, the framework having a castered undercarriage.

The Hart, Jr. U.S. Pat. No. 5,016,893 discloses a similar collapsible support and transport stand for a personal water craft used for transporting the craft over beach terrain. The stand includes a cradle on telescoping legs extending to a pair of retractable wheeled skids. The stand is collapsible to a flat configuration.

The Raymond U.S. Pat. No. 5,163,378 discloses a ground supported boat lift including a frame which is pivotally movable about two shorter spaced apart parallel legs connected at each rear corner of the frame from an upright position to a generally horizontal position of the frame. A boat cradle extends perpendicularly between the legs and is raised from being in close proximity to the ground to being above the ground by the legs as the frame is pivoted into a horizontal position. Optional removable wheels and a trailer tongue convert the device to a more conventional boat trailer.

Also, the Gettman U.S. Pat. No. 5,249,545 discloses a lightweight cradle system for use in launching, beaching, transporting and storing personal water craft, such as Jet-Skis. The cradle system cradles a personal water craft with side and front support pads, and with roller systems at the lower aspect thereof. During use water is allowed to enter hollow side pipes and provide stabilizing effective weight to the cradle system. Use of the present invention allows an unaided young or small physical stature person to safely secure a launched personal water craft without causing damage thereto. The present invention also provides elements which allow grasping and carrying of a cradle system/personal water craft combination by two or more physically capable persons.

As will be described in greater detail hereinafter, the present invention can provide the owner of a personal water craft with an easily transported mooring standoff apparatus which provides a safe mooring at a shoreline area for the personal water craft, with floating momentum of the water craft being used to load and unload the craft therefrom, and with the water craft being lifted out of the water when moored on the apparatus.

SUMMARY OF THE INVENTION

According to the invention there is provided a portable folding personal water craft mooring standoff apparatus. The apparatus provides a means by which a craft can be safely moored adjacent a shoreline, the apparatus being positioned just off the shore in shallow water. The apparatus consists of two main components comprising a base and a cradle for the craft. The cradle receives the personal water craft thereon and is pivotally mounted on the base for accommodating a rocking movement along the fore and aft axis of the water craft, with structure provided to stop forward motion of the cradle when the water craft is in a moored horizontal position thereon, the craft being lifted out of the water when moored on the apparatus. The base includes hinging to allow folding of same with the cradle and base being engageable to one another compactly for transportation thereof.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
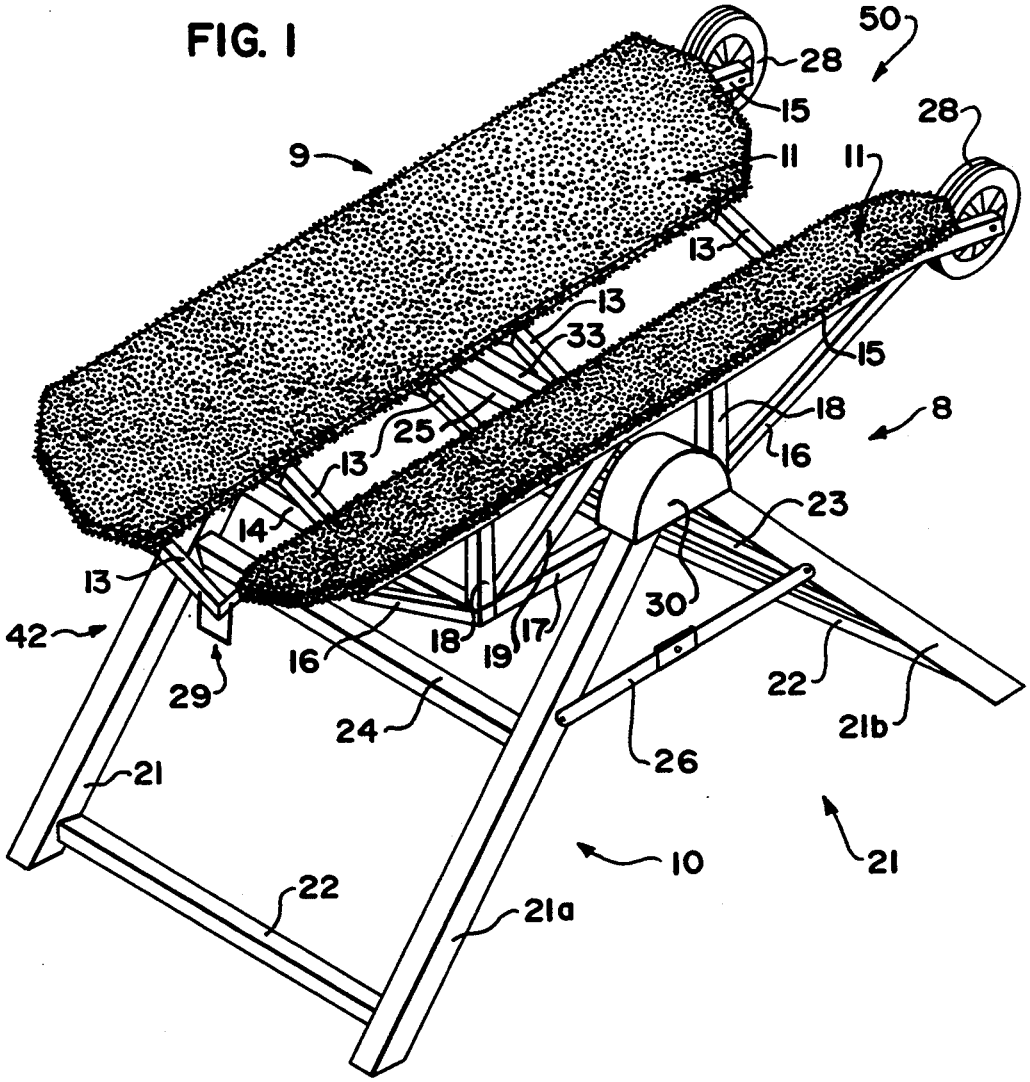
FIG. 1 is a perspective view of a portable folding personal water craft mooring standoff apparatus made in accordance with the teachings of the present invention.

Referring now to the drawings in greater detail, there is illustrated in the Figures the novel portable folding personal water craft mooring standoff apparatus of the present invention generally identified by reference numeral 8.

As shown the apparatus 8 comprises two main components, a cradle 9 and a base 10.

The cradle 9 mounts to the base 10 in a manner to be pivotable relative to the base 10.

In this respect, it will be seen that the base 10 comprises a pair of spaced apart hinged legs 21 which are engaged to one another by means of a plurality of cross braces 22, 23, 24 and 25. Since the legs 21 are hinged and configured into an inverted V, the spread of each hinged leg 21 is restricted by the provision of a folding brace 26 extending between sections 21*a* and 21*b* of the leg 21 beneath a hinge 20, the hinge 20 being centered along the length of the leg 21, with the hinge 20 being covered by a cap 30 if desired. It will be understood that the hinge 20 has a pin and pivot sleeve arrangement 41.

The cross braces 24 and 25 are positioned in such a manner as to have a dual purpose. The braces 24 and 25 not only maintain the legs 21 in parallel, spaced apart relation, but act as stop members 24 and 25 for limiting rearward and forward tilt, respectively, of the cradle 9 when the cradle 9 is engaged to the base 10, as will be described in greater detail hereinafter.

Also, the two bottom cross braces 22 serve a secondary function. In this respect, when the apparatus 10 is set onto a soft underwater surface, the legs 21 will sink into the soft material, with the braces 22 acting as stabilizers for the apparatus 10 when the braces 22 sink into the soft surface.

Turning now to an overview of the cradle 9, it will be seen that the cradle 9 includes two side flanges or supports 15 which are engaged to one another by a plurality of depending cross flanges 13.

Mounted along the length of each flange 15 is a craft engaging pad 11.

The pads 11 are parallel and can be distanced from one another in one of several positions to accommodate the configuration of a bottom surface of the particular water craft to be mounted thereon. It will further be seen that the pads 11 are tilted toward one another, creating the cradle 9 for the water craft therebetween. It will be understood that the cross flanges 13 are formed as depending members to allow for clearance of the water craft as it is loaded onto and unloaded from the apparatus 8.

Each hinge 20 incorporates therein a channel 12 which engages a pivotable rod 40, each rod 40 engaging to a corresponding center depending cross flange 13 for the cradle 9. Thus, the cradle 9 can pivot about the rods 40 in a fore/aft direction, with the extent of pivotability being limited by cross braces 24 and 25.

As the personal water craft is moved on to the cradle 9 from an aft end 42 thereof, weight is transferred across a center line of apparatus 8 defined by the rods 40. Weight is then distributed from the cradle 9 to the hinges 20 of the base 10, distributing the weight onto the vertical legs 21. As the personal water craft continues its forward movement onto the cradle 9, weight is transferred still further across the center line of the base 10, causing the cradle 9 to pivot forwardly, the rods 40 rotating within the channels 12. As the cradle 9 pivots forward, the personal water craft, together with a drive unit thereof, is lifted from the water ceasing forward movement. The cradle 9 continues to pivot until a cradle stop 33 contacts the base pivot stop cross member 25.

To limit rearward motion, a stop member 14 is provided which engages against cross member 24, defining the limit of rearward tilt thereagainst.

Figure 2:
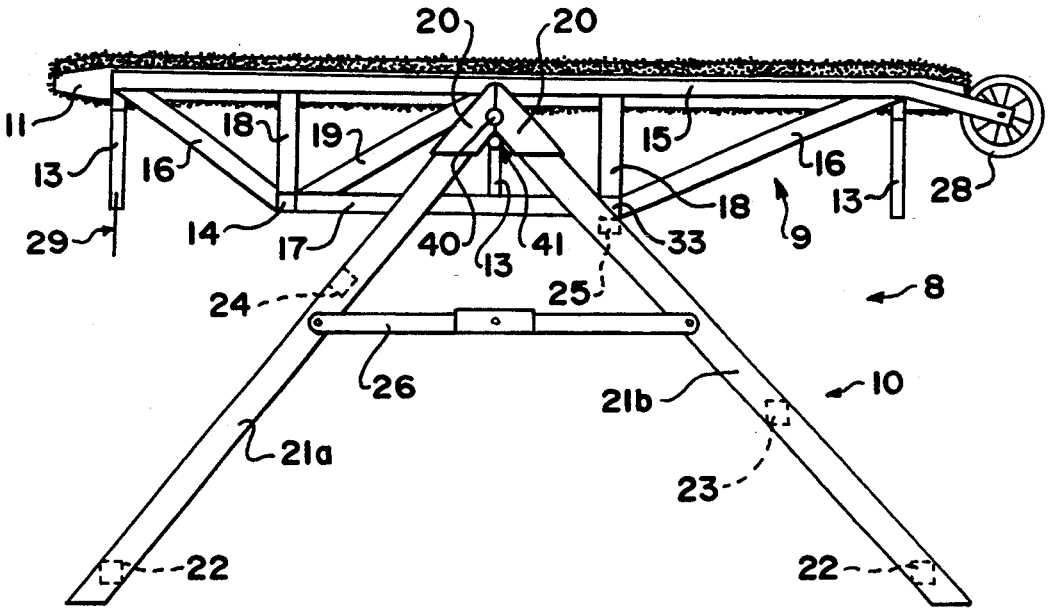
FIG. 2 is a side view of the apparatus showing same in a mooring position thereof.
Figure 3:
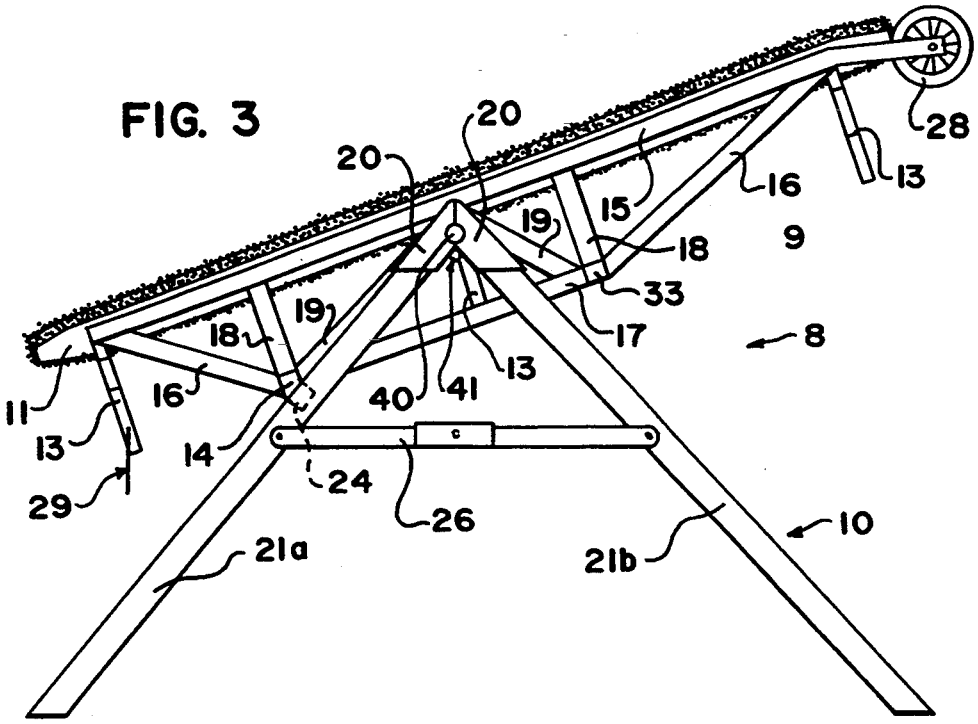
FIG. 3 is a side view similar to FIG. 2 and showing same in a load/unload position thereof.
Figure 4:
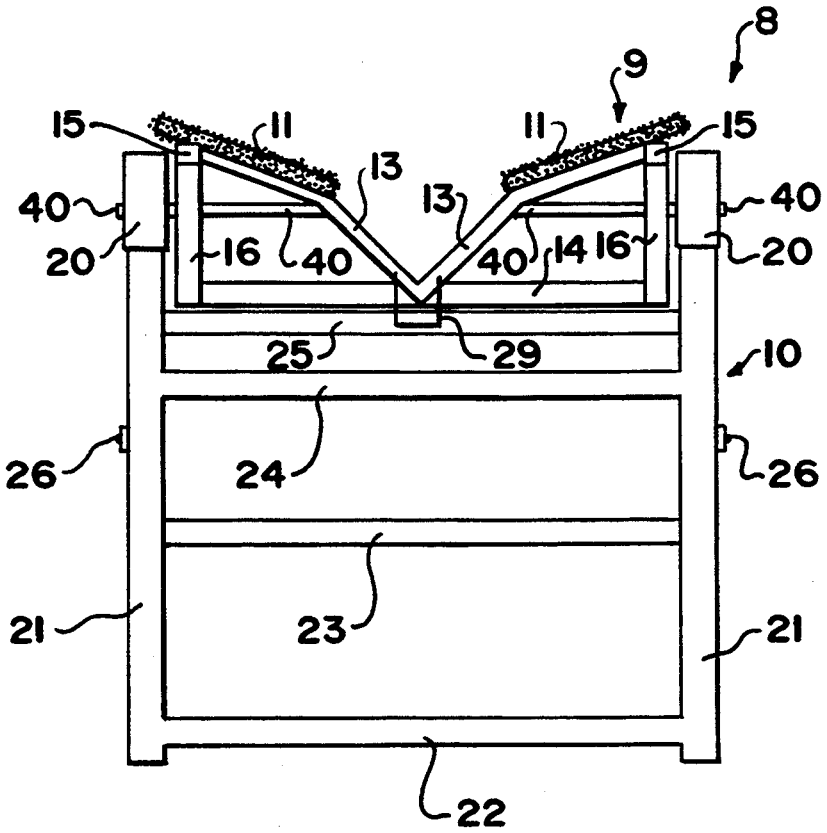
FIG. 4 is a front end view of the apparatus.
Figure 5:
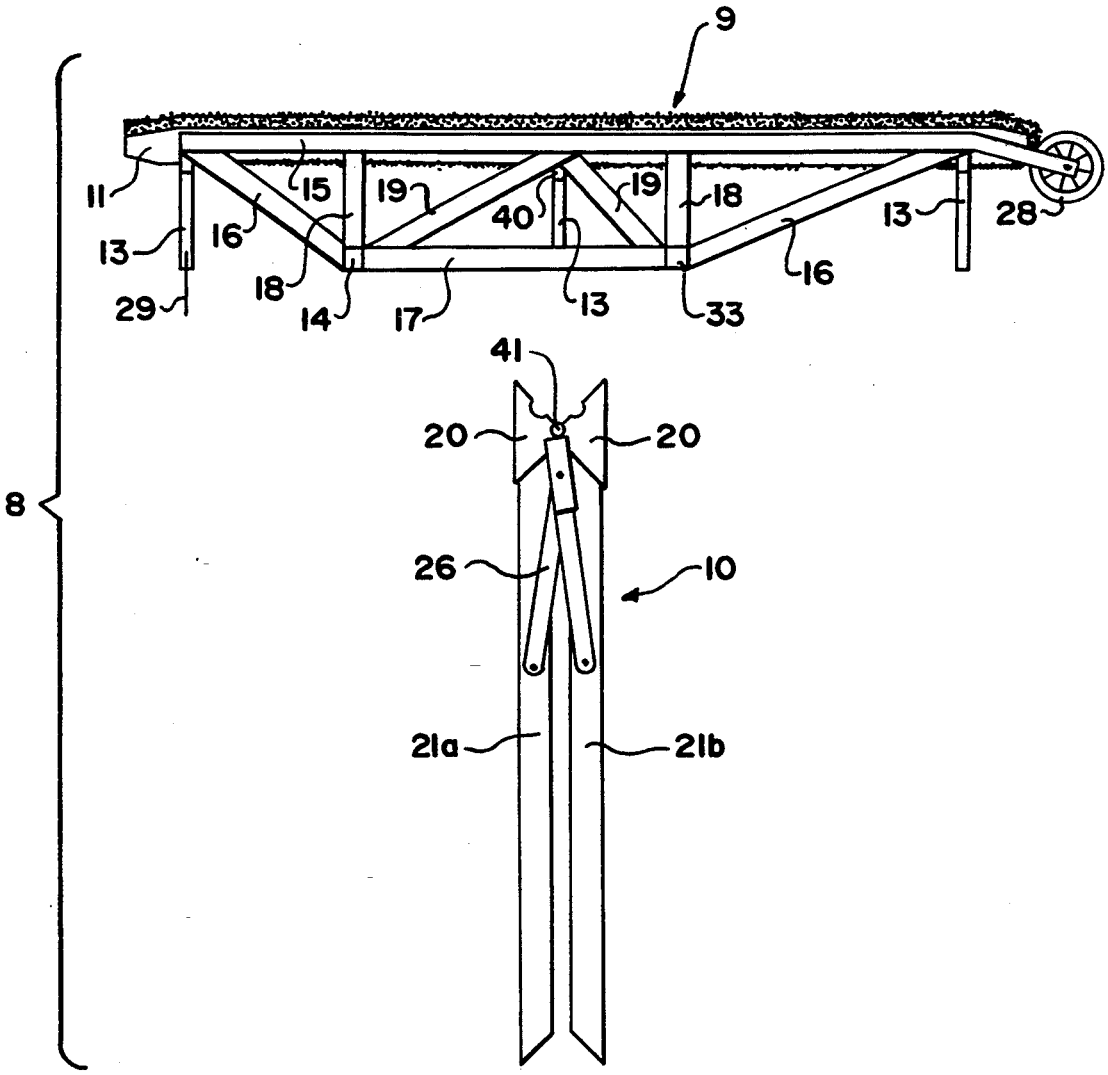
FIG. 5 is a side view of the apparatus showing same disassembled and showing a base thereof folded for transport.

It will be seen best from FIGS. 2 and 3 that cross brace 25 is set at a point where engagement between the brace 25 and the stop member 33 causes cradle 9 pivoting to cease and maintains the cradle 9 horizontal.

It will also be seen that cross brace 24 is placed substantially lower to allow end 42 to pivot downwardly into the water for receipt of the water craft thereon, while limiting further downward pivoting of end 42.

To accommodate for the large space between braces 22 and 25 on leg portion **21*b*, the extra cross brace 23** has been provided for support.

Because of the length of the supports 15 and relative distance between the depending cross flanges 13, for stability, angulated braces 16 are run from each end of the support 15 toward and into engagement with the respective stop member 14, 33.

It will be seen that each stop member 14, 33 is positioned at a bottom end of a depending arm 18, added for lateral stability, and with a horizontal rod 17 extending between the arms 18, to provide a "closed box" configuration to framework of the cradle 9.

Also, if desired, secondary angulated braces 19 may be engaged from a center point of the flange 15 to each angle point created by the arms 18 and horizontal rod 17.

Figure 6:
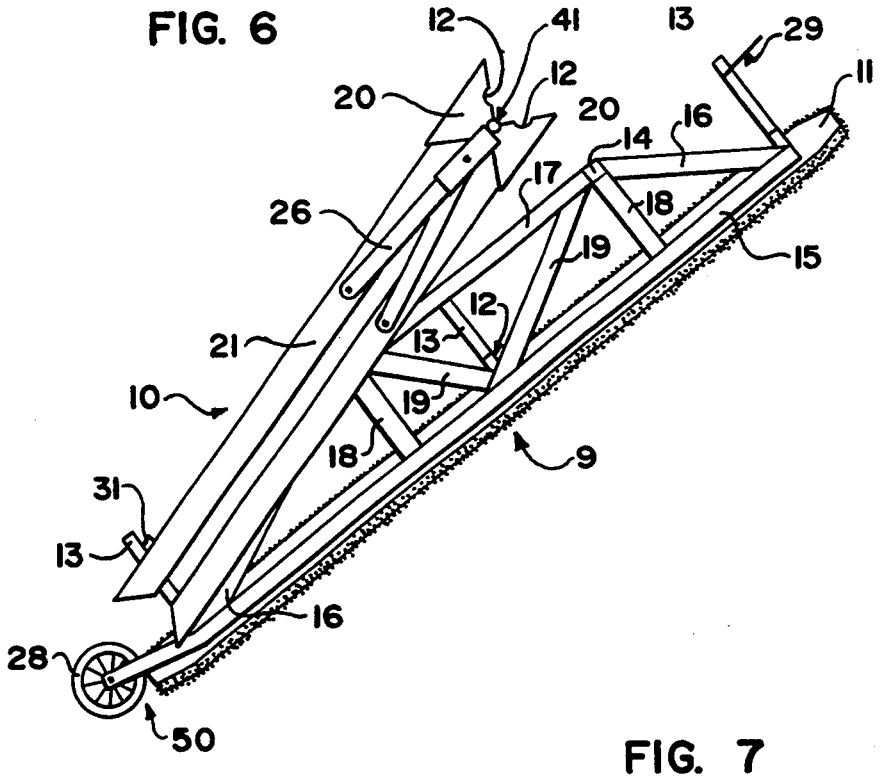
FIG. 6 is a side view of the apparatus showing same readied for transport thereof.
Figure 7:
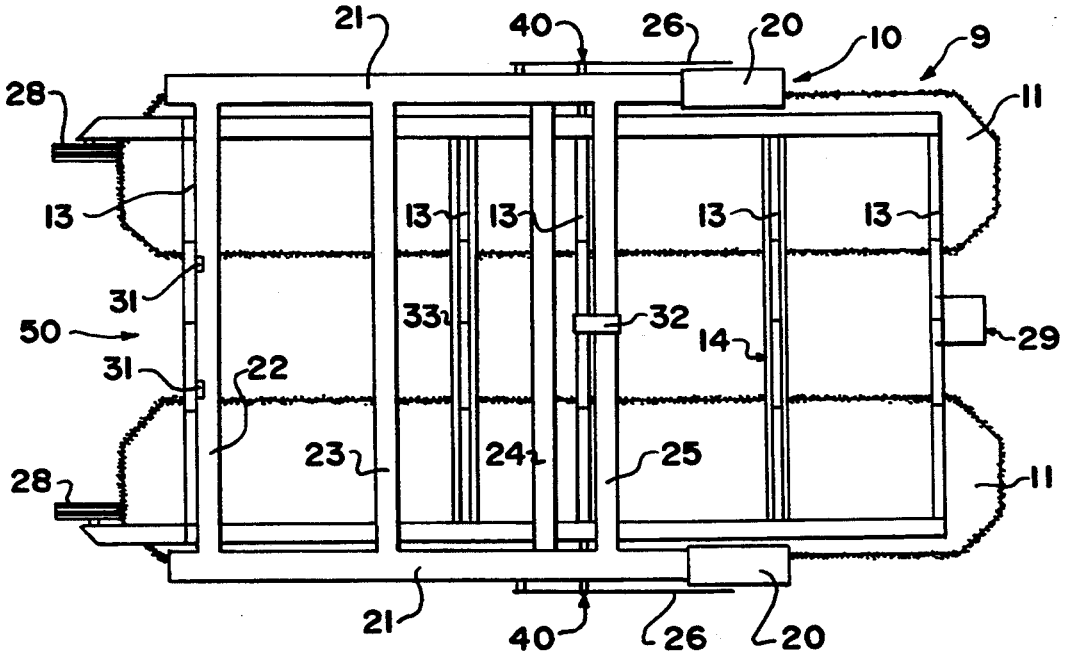
FIG. 7 is a top plan view of the structures as shown combined in FIG. 6.
Figure 8:
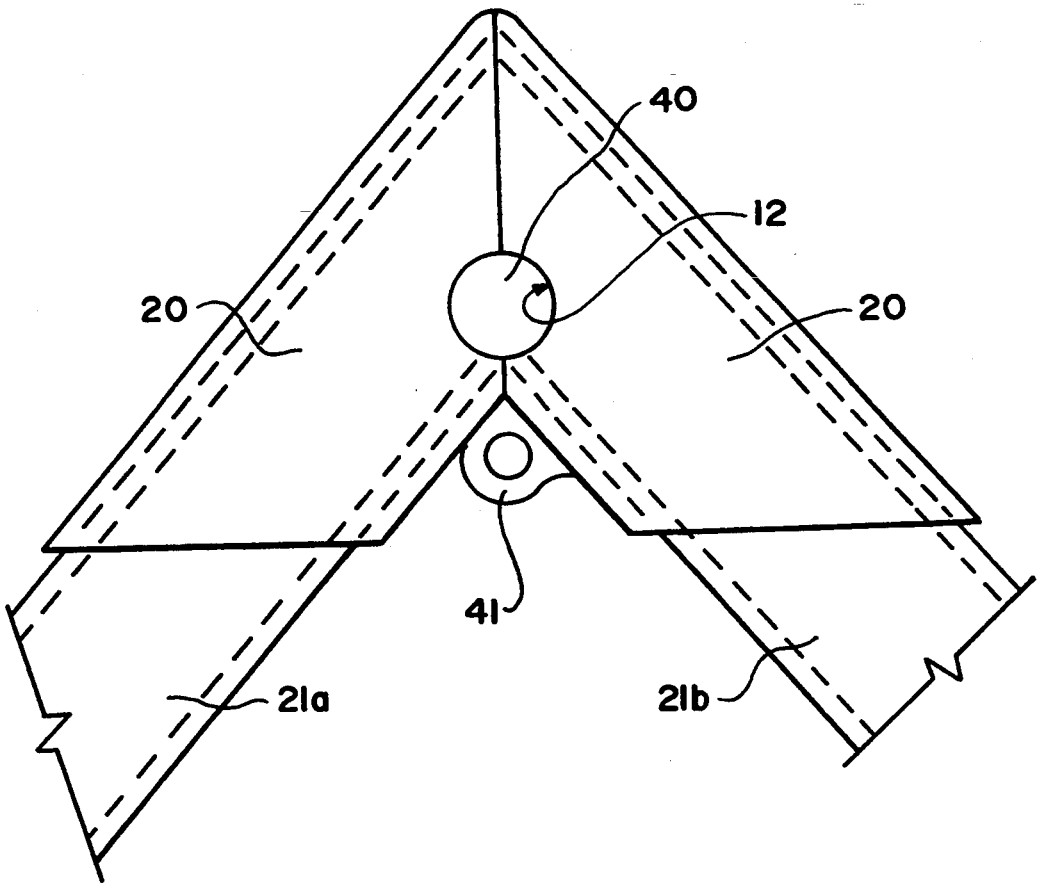
FIG. 8 is an enlarged side view of a top area of one leg of the apparatus base.

The portable folding personal water craft mooring standoff apparatus 8 can be disassembled, folded and removed from the water. Once removed, the base 10 can be strapped to the cradle 9, as shown in FIG. 7, and wheeled away for storage, as shown in FIG. 6. This process is accomplished by approaching a vacant portable folding personal water craft mooring standoff apparatus 8, standing behind it, grabbing the two folding braces 26, and pulling up on them until the base 10 folds on its hinges 20 sufficiently to allow the two axial pivot rods 40 to be removed from the channels 12, disengaging the cradle 9 from the base 10. The cradle 9 is carried to a flat surface away from the water's edge and is placed upside down with the pads 11 contacting the underlying surface. The base 10 is then retrieved and folded flat by folding the leg portions **21*a* and 21*b* against one another, with folding taking place about the hinges 20. The base 10 is then placed on the cradle 9 as shown in FIG. 7. Base cross member 22 is then placed under clips 31 on the pad supports 13 on an end 50 of the cradle 9. The base cross member 25 is then strapped to a pad support 13 having a strap 32 fastened to it. The base 10 is piggybacked onto the cradle 9, for transportation. The assembly is lifted by the grab handle 29 until wheels 28 provided at end 50 of cradle 9 contact the underlying surface as shown in FIG. 6. This assembly can be wheeled along by pulling on grab handle 29 and rolling along on wheels 28. Alternatively, the apparatus 8 is so light that the cradle 9 and base 10** can be moved individually, by hand.

In reassembling the apparatus 8, the above steps are reversed.

As shown, the apparatus 8 provides a number of advantages,some of which have been described above and others of which are inherent in the invention. For example, by provision of the pivotable cradle 9, not only is a water craft moored thereon but it is lifted out of the water as well, so that the tides have no possibility of disengaging or damaging the craft. Also, modifications may be proposed to the apparatus 8 without departing from the teachings herein. Accordingly, the scope of the invention is only to be limited as necessitated by the accompanying claims.

I claim:

1. A portable personal water craft off shore mooring apparatus comprising a base and a pivotable cradle mounted thereon, the cradle pivoting in response to weight of the water craft as the water craft is propelled onto and off of the cradle, the cradle lifting the craft above a water line at the shore when the craft is moored on the apparatus;

said base comprising two legs configured into an inverted V, with the legs being parallel and spaced apart, spacing between the legs being maintained by a plurality of cross members extending therebetween;

said cradle comprising a framework sized and configured to mount pivotably to the base, between the legs, the framework being centered upon the base, and;

said framework having two pads mounted thereon, the pads being parallel and spaced apart with a slight angulation toward one another to receive a bottom surface of a water craft thereon and therebetween.

2. The apparatus of claim 1 wherein said framework includes at least one wheel mounted at one end thereof.

3. The apparatus of claim 2 wherein said base legs fold together and are adapted to seat upon said framework when disassembled therefrom.

4. The apparatus of claim 3 wherein said cradle framework is narrower than the spacing between said legs.

5. The apparatus of claim 4 wherein said cradle framework and said base are engaged to one another by means of pivots, the pivots being centered along a length of said framework and engaging adjacent an uppermost point of said legs.

6. The apparatus of claim 5 wherein said leg engaging cross members are positioned to act as stop members for limiting pivoting of the framework when mounted to and between the legs.

* * * * *